US006357206B1

(12) United States Patent
Kyle

(10) Patent No.: US 6,357,206 B1
(45) Date of Patent: Mar. 19, 2002

(54) PACKAGING METHOD

(76) Inventor: Kenneth E. Kyle, 36 Sportsman's Hill Rd., Madison, CT (US) 06443

( * ) Notice: Subject to any disclaimer, the term of this patent is extended or adjusted under 35 U.S.C. 154(b) by 0 days.

(21) Appl. No.: 09/602,682

(22) Filed: Jun. 26, 2000

Related U.S. Application Data

(62) Division of application No. 09/035,803, filed on Mar. 6, 1998, now Pat. No. 6,123,195.

(51) Int. Cl.[7] ..... B65B 23/00
(52) U.S. Cl. ..... 53/399; 53/410; 53/472
(58) Field of Search ..... 53/399, 410, 472, 53/419; 206/478, 482; 410/98, 85, 101, 109, 112

(56) References Cited

U.S. PATENT DOCUMENTS 4,219,229 A * 8/1980 Ciocan ..... 410/101
4,741,653 A * 5/1988 Schmidt ..... 410/112
4,941,572 A * 7/1990 Harris ..... 53/472
5,180,263 A * 1/1993 Flowers ..... 410/101
5,419,603 A * 5/1995 Kremer ..... 410/112
5,752,791 A * 5/1998 Ehrlich ..... 410/101
5,934,849 A * 8/1999 Haire ..... 410/112

FOREIGN PATENT DOCUMENTS

JP 162258 * 3/1991 ..... 206/478

* cited by examiner

*Primary Examiner*—John Sipos
(74) *Attorney, Agent, or Firm*—Robert H. Montgomery

(57) ABSTRACT

A method of securing an article in a container or to a panel member for insertion in a container for shipping comprising providing at least two anchor clips extending into the container through the bottom, side panel or a corner of the container and defining an eye or aperture through which strapping is passed. The strapping is secured at its free ends by a friction buckle or other securing device and extends about the article to be shipped to secure the article at a given location within the container. The clips have a base which engages, essentially flush, an outside surface, outside wall or outside corner of the container and an upstanding leg which extends through the bottom, wall or corner of the container. The eye or aperture through which the strapping passes is defined in the legs extending into the interior of the container. In an alternative embodiment, a separate panel member is used to accept the anchor clips and the separate panel member is later inserted into the container with an article secured thereto.

22 Claims, 3 Drawing Sheets

PACKAGING METHOD

RELATED APPLICATIONS

This application is a division and of application Ser. No. 09/035,803, filed Mar. 6, 1998, now U.S. Pat. No. 6,123,195.

FIELD OF THE INVENTION

This invention relates to a method of packaging articles in a container.

BACKGROUND OF THE INVENTION

Articles of all kinds are commonly shipped in what is referred to as paper board boxes, sometimes referred to as boxboard, of a size selected in accordance with the size of an article to be shipped. Cardboard and paper boxes are generally made in standard sizes and sold to a shipper, either manufacturer or merchandiser, in unassembled flat form for ease of storage. In some instances a high volume shipper may have boxes of a specified size made. These will also be in unassembled flat form for ease of storage.

When needed, the boxes are assembled for shipping, the desired articles are packed therein with a selected filler and forwarded to a recipient.

To render the articles immobile or immovable in the container a filler of some type, commonly referred to as dunnage is packed about the article in the container. Paper or shreded paper has been used as a packing in the past to fill voids in the box around the article in the box. The use of small expanded plastic elements, often referred to as "peanuts" is in widespread usage, but is expensive. Such peanuts may be ineffective for very heavy items in that they may not restrain movement of heavy objects. Additionally, they are environmentally difficult to dispose of. In some case, such packing has been used where a plurality of small items either boxed or not boxed are shipped in a larger box.

Such packing or fillers, while usually effective for the intended purpose are a nuisance to both the shipper and the recipient. The shipper must maintain a large inventory of packing material which necessarily requires much space. The recipient of the article has the task of disposing of the filler as well as the box. It is not uncommon thar the box is disposed of as trash with the filler therein. If there was no filler, the box could be knocked down and more easily disposed of.

In some cases, a manufacturer or merchandiser may use molded pieces of lightweight plastic having exterior dimensions complementary to the interior dimensions of the shipping box. Such molded pieces define an interior cavity shaped in accordance with articles to be shipped. This method of shipping is usually used in conjunction with higher priced articles of high volume. The molding or creation of such packing pieces places an additional cost burden on the manufacture or merchandiser and the molded packing pieces must define a customized cavity for each different article.

In many cases a manufacturer or merchandiser may wish to ship an article which is not amenable to conventional packing or filling and/or whose volume does not justify the cost of the molded cavity defining pieces for packaging, yet still wants to to secure and render the article in a standard size box.

The present invention provides a new and improved packaging system, method and components used therein for securing articles to be shipped within a standard shipping box without having to use dunnage or only a small amount of dunnage materials depending on the shipper's specifications.

An object of this invention is to provide a new and improved system and components therefor for securing an article in a box without having to utilize a loose packing material or molded inserts.

Another object of this invention is to provide a new and improved method and inexpensive components used therein which are adaptable to secure almost any type of object in a selected size box without requiring dunnage.

A further object of this invention is to provide a new and improved strap and anchor technique in securing articles in boxes for shipping.

A still further object of this invention is to provide a new and improved securing system using anchoring clips which serve as attachment points for interior strapping, cordage or wire which will restrain the object to be shipped in the container.

SUMMARY OF THE INVENTION

Briefly stated, the invention, in one form thereof, comprises anchor clips extending into a container through the bottom or a wall thereof, usually the bottom or even a corner thereof and defining an eye through which strapping is passed. The strapping is secured at its free ends by a joining device such as a friction buckle or compressible clamp and extends about the article to be shipped to secure it at a given location within the container. The anchor clips have a base, which engages an outside surface, or surfaces in the case of a corner clip, and an upstanding leg which extends through a slit in the container. The leg has at least one eye defined therein to receive the strapping.

The features of the invention which are believed to be novel are particularly pointed out and distinctly claimed in the concluding portion of this specification. The invention, however, together with further objects and advantages thereof, may best be appreciated by reference to the following detailed description taken in conjunction with the drawings.

DETAILED DESCRIPTION OF THE DRAWINGS

FIG. 1 is a plan view of a cardboard container with its top flaps removed showing a T-shaped article secured therein in accordance with the invention;

FIGS. 2 and 2*a* are elevation views of an anchor clip utilized in practice of the invention;

Figure 1:
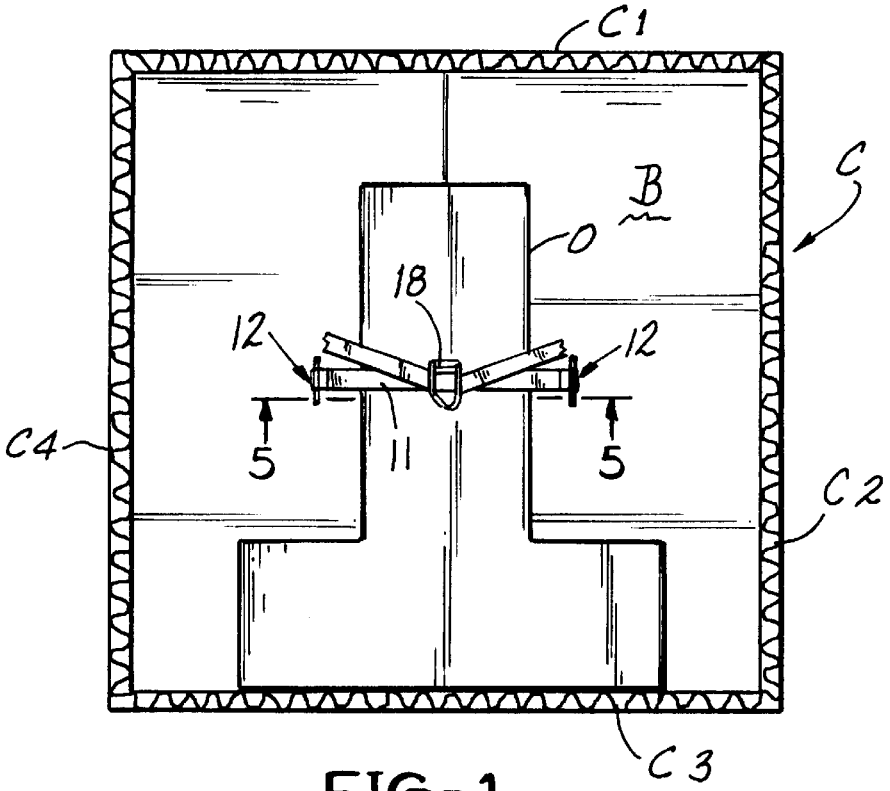
Figure 4:
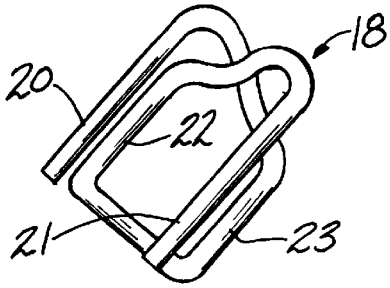
FIG. 4 is a perspective view of a strapping buckle which may be used in practice of the invention.
Figure 8:
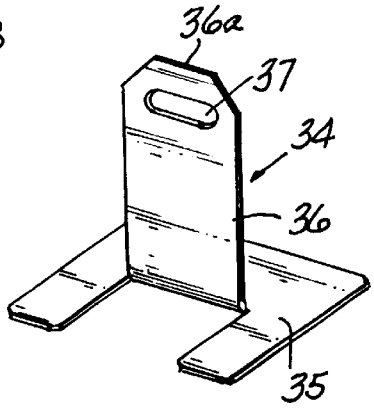
Figure 5A:
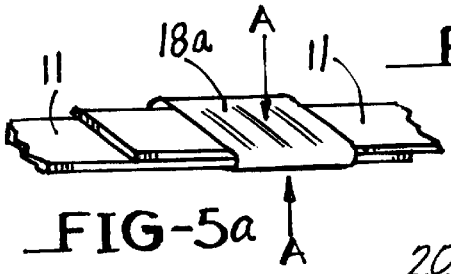
Figure 5:
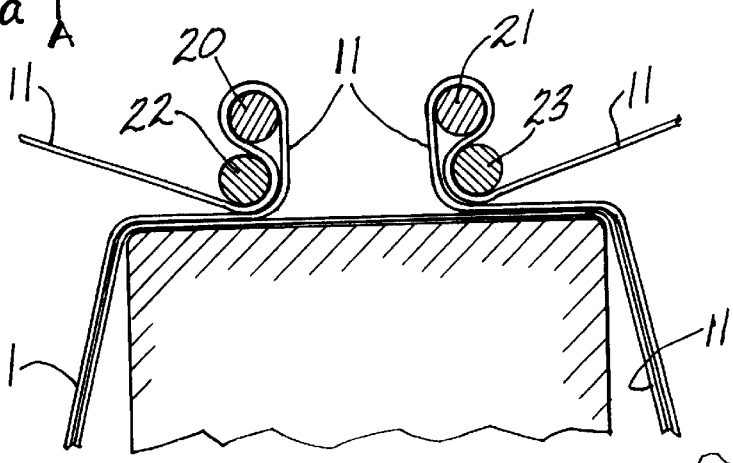
Figure 7:
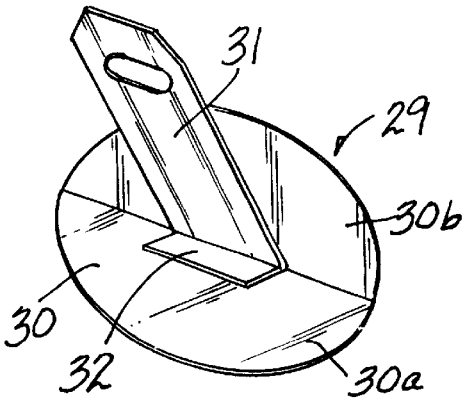
Figure 6:
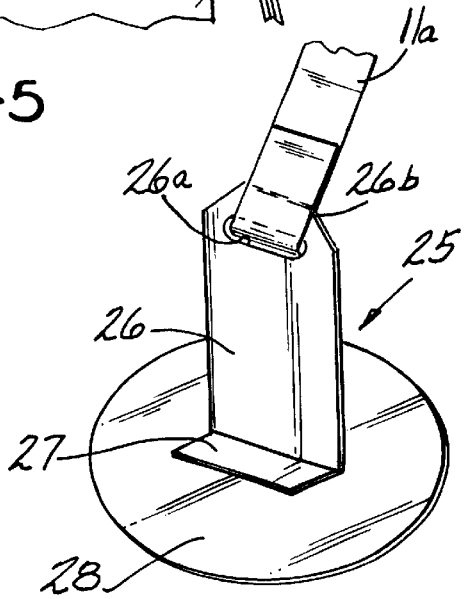
Figure 9:
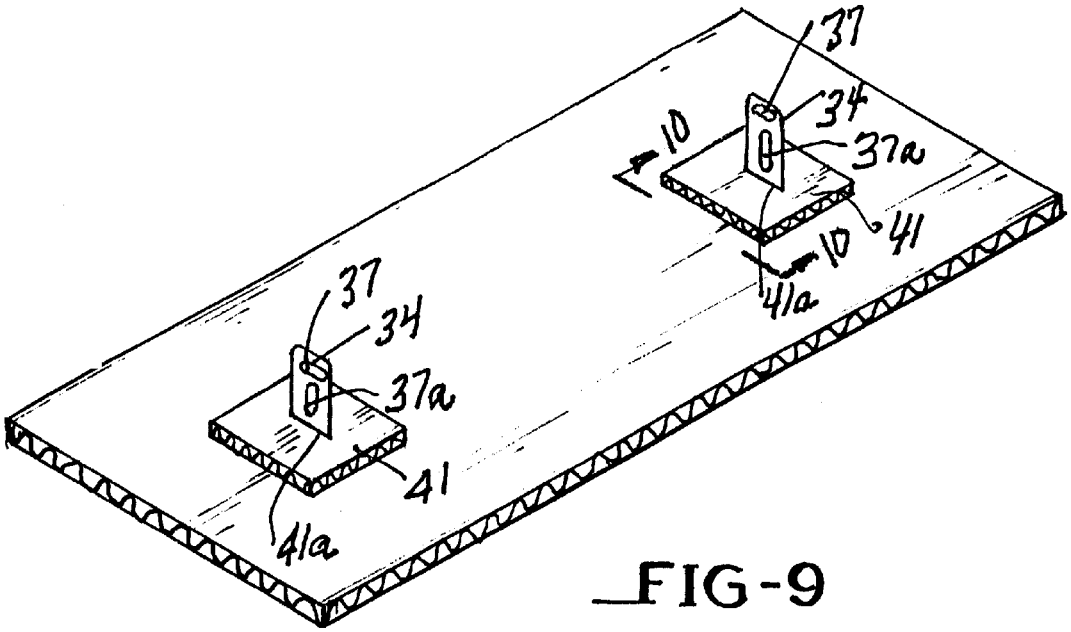
Figure 10:
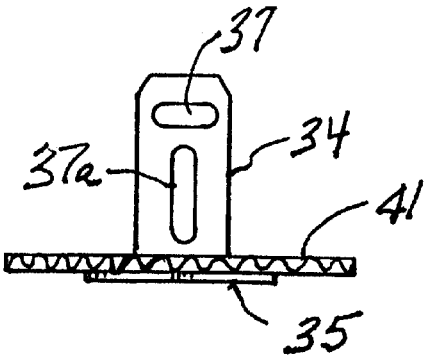

FIG. 5*a* is a perspective view of a crimped seal on the free ends of the strap;

FIG. 5 is a sectional view of the buckle of FIG. 4 with strapping connected thereto seen in the plane of lines 5—5 of FIG. 1;

FIG. 6 is a perspective view of another anchor clip;

FIG. 7 is a perspective view of an anchor clip for placement at the corner of a container;

FIG. 8 is a perspective view of of another anchor clip which may used in the invention;

FIG. 9 is a perspective view of a panel member which may be a panel of a box or a separate panel for insertion in a box or shipping container:

FIG. 10 is a view seen in the plane of lines 10—10 of FIG. 9; and

Figure 11:
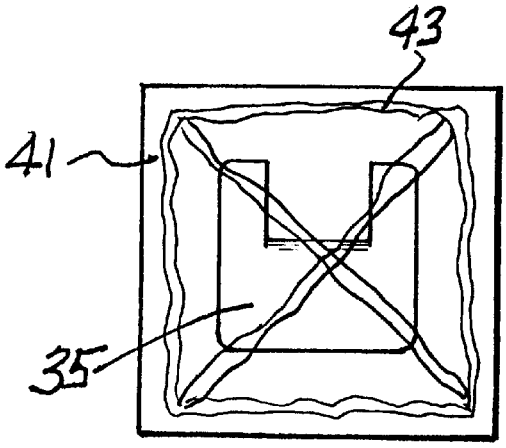

FIG. 11 is a bottom view of the structure of FIG. 10.

DESCRIPTION OF PREFERRED EMBODIMENTS OF INVENTION

A container C of rectangular parallelepiped geometric shape is shown in FIG. 1, in plan view, with its top flaps removed. Container C has sides C1–C4 and a bottom B defined by the usual fold over flaps. Container C is of a common construction of boxboard comprising a corrugated interior covered with linerboard on either side.

Within container C is an object O shown as T-shaped. Object O is secured in Container C by a strap 11 which is attached to container C by means of two anchor clips 12. The free ends of strap 11 are joined by a fastening device such as a friction buckle 18 shown in block form and hereinafter more fully illustrated and described.

Figure 2:
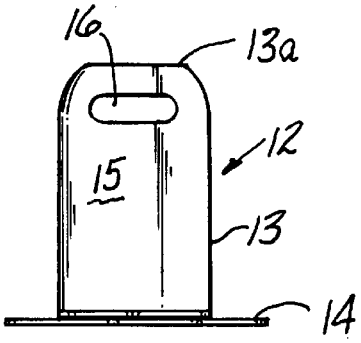
Figure 2A:
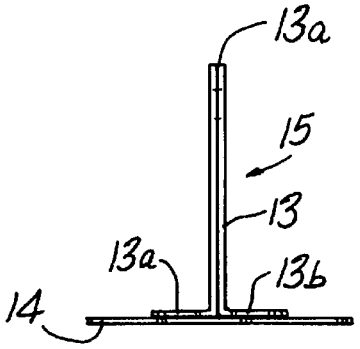

An anchor clip 12 is shown in FIGS. 2 and 2*a*. An anchor clip 12 comprises a base 14 of circular configuration, and an upstanding leg 15 having an aperture or generally rectangular eye 16 defined therethrough adjacent the free end 13*a* of leg 13. Eye 16 receives strap 11 therethrough to anchor strap 11 to bottom B. Legs 13 of anchor clips 12 extend through bottom B, usually two bottom flaps, through slits, (not shown) but hereinafter discussed, defined in bottom B.

The bases 14 of anchor clips 12 will be essentially flush with the outside surface of bottom B with the legs extending through the defined slits. The bases 14, being flush with the outside surface of a wall of the container, react forces exerted on the legs 13 by the tension in the strapping 11 when the ends of the strapping are joined. The slits may be defined to the exact width of legs with a knife 17 having a symmetrical triangular shaped blade 17*a* fitted to a handle shown in FIG. 3. The blade 17*a* of knife 17 at its base is generally of the same dimension as the leg of an anchor clip and of substantially the same thickness as the leg.

The bases 14 of the anchor clips 12 may be covered with a tape if deemed necessary, for example, standard two inch wide packaging tape. However, as previously pointed out the bases of the anchor clips are essentially flush with a wall(s) of a container and such covering is not deemed necessary unless the Postal authorities and/or the shipper or carrier make such requirement.

Figure 3:
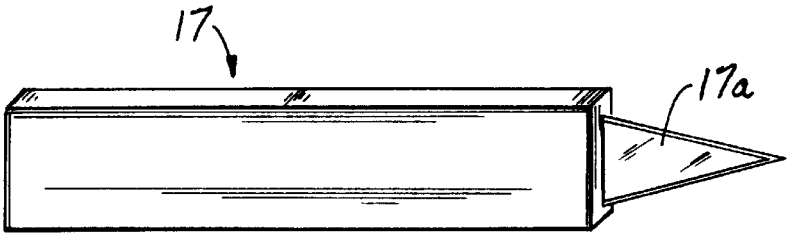
FIG. 3 is a view of a cutting and puncturing tool useful in practice of the invention.

The base 14 of a clip 12 as shown in FIGS. 2 and 2*a* has been made one and one-eighth inches in diameter so as to be completely covered by the aforementioned packaging tape. The leg 15 is made about three-quarters of an inch wide to provide for an eye 16 which will receive the standard one-half strapping 11. Leg 15 is made about one and one-half inches long to allow it to be inserted through a slit defined by a knife as shown in FIG. 3, and the eye readily accessible from the interior of the container.

One type of fastening device for the free ends of strap 11 is a buckle 18 for frictional engagement of strapping 11 as shown in FIG. 4. This buckle 18 is formed of heavy wire stock defining essentially parallel arms 20–23 and provides frictional engagement of the strapping 11 as the strapping 11 is wound about the arms 20–23 of the buckle, as shown in FIG. 5. Kits including the strapping 11 and buckles 18 are available from International Plastics, Inc. of 185 Commerce Center, Greenville, S.C., among others. Instead of the buckle 18, a crimped metal seal may be used to secure the free ends of strap 11 together. Such seals and crimping tools therefor are available from the same source, as well as other sources. The strapping 11 is preferably of polypropylene or polyester cords. However other types of strapping or securing materials may be used. As used herein "strapping" includes cordage and wire. The fastener 13 will be selected in accordance with the type of strapping used.

Another anchor clip 25 is shown in perspective in FIG. 6. A leg 26 is formed with a bottom flange 27 which is affixed to a base 28 as by spot welding, solder brazing or any other suitable bond. The anchor clips may also be molded of a suitable plastic. The dimensions of the clip are substantially as previously stated.

FIG. 6 also exemplifies another embodiment of the invention where strapping is passed through the eye 26*a* adjacent the free end 26*b* of leg 26 and secured to itself by any suitable means such as stapling, adhesive or heat bonding. In this embodiment an anchor clip 25 may be prepared with strapping attached thereto and eliminate the assembly step of threading a strap through the eyes of the anchor clips. The leg of an anchor clip may be inserted into a container as previously described and the strap is then pulled through the defined slit.

An anchor clip 29 designed to be inserted through a corner of a container is shown in FIG. 7. The base 30 Of clip 29 is bent at a ninety degree angle. The leg 31 has a lower flange S 32, bent at forty-five degrees which is attached to base 30 as previously described. Leg 31 bisects the ninety degree angle formed between the two defined sections 30*a* and 30*b* of base 30.

FIG. 8 shows another anchor clip 34, which is formed in one piece. Anchor clip 34 has a base 35 and an upstanding leg 36 having an eye 37 defined therein adjacent the free end 36*a* of leg 36. Anchor clips 34 may be formed by repeatedly stamping a moving strip of material to define the side edges of leg 36, free end 36*a* and eye 37. Then leg 36 is bent upwardly to fully define the anchor clip. The leg 36 may be dimensioned as previously stated and the overall rectangular dimensions of base 35 of about one and three-eighth inch on each side.

The corners of the free ends of the legs of all anchor clips are tapered or cut on a bias to facilitate insertion into and through the defined slits. The legs of all anchor clips may be made the full diameter of the base (except FIG. 8). However, the legs need only be wide enough an aperture or eye for the strapping used.

The anchor clips may be formed by a variety of techniques. For example they may be molded of plastic. The eyelet in a leg for a strap may be punched or otherwise defined in the leg at any point in a production line. In such manufacturing techniques the bases may be rectangular or circular.

When made of metal, the base and leg is preferably 0.020–0.025 inch thick and 0.040–0.045 when molded of plastic.

Another arrangement for practicing the invention is illustrated in FIGS. 9–11. A panel member 40 is shown in FIG. 9 which is representative of the bottom or side panel of a container, or a separate panel of predetermined size to be inserted into a container. Panel member 40 is shown as a typical construction of boxboard with a corrugated center between layers of linerboard. In this arrangement of the invention anchor pads 41, also of cardboard, are utilized to receive anchor clips 34, as shown in FIG. 8. Dependent upon the weight of the article to be secured, the anchor pads 41 may be made of double or triple wall boxboard.

The anchor pads 41 may be stamp cut of a predetermined size with slits 41*a* therein or the slits defined as previously described. The anchor clips 34, as shown in FIG. 8 are then inserted through the defined slits 41*a*. An anchor pad 41 with an anchor clip 34 therethrough is shown in FIG. 10. The anchor clip 34 of FIG. 10 has an additional vertically directed eye 37*a* defined therein. Alternatively, the anchor clip 34 of FIGS. 9 and 10 may have strapping attached thereto as shown in FIG. 6. The vertical eyes 37*a* are provided to give additional anchoring strength if wire is used as the strapping material. If wire is used the ends of the wires are twisted together to join and tension the securing wire.

The bottom of an anchor pad 41 with an anchor clip 34 therein has a bonding agent shown as glue 43 applied thereto. The anchor pad 41 is then placed in contact with panel member 40 and adheres thereto. A suitable adhesive is hot glue applied with a conventional hot glue gun. This glue bonds rapidly. When applied to an anchor pad 41 of four inch by four inch dimension and of double wall construction in substantially the pattern shown in FIG. 11, hot glue will provide a bond which will react about thirty pounds. The holding force may be increased by the application of additional glue and/or increasing the area of the anchor pads.

The invention may be practiced in accordance with FIGS. 9–11 in instances where a number of the same articles are to be packaged for shipment. In such cases, the articles to be shipped are secured, in one of the manners previously described, to panel members 40 of predetermined size selected in accordance with the size of the shipping container. The panel members 40 with the articles thereon are then inserted into the containers. A panel member 40 may be secured in a container by use of the same glue, the container closed and then transported to a shipping location.

The invention provides an economical and simple system and method of securing an article in a container of standard size without the use of dunnage or a substantially reduced amount of dunnage.

It may thus be seen that the invention efficiently attains the objects of the invention set forth above as well as those made apparent. While preferred embodiments of the invention have been set forth for purposes of disclosure, other embodiments as well as modifications to the disclosed embodiments may occur to others. Accordingly, the appended claims are intended to cover all embodiments of the invention as well as the disclosed embodiments which do not depart from the spirit and scope of the invention.

What is claimed is:

1. A method of securing an article in a container which comprises the steps of providing at least two anchor clips, each anchor clip comprising a generally planar base having an upstanding leg, said leg having a free end opposite said base, said leg defining an aperture therein adjacent said free end, defining slits in a panel of said container at predetermined locations, inserting said legs through said slits from the outside of the container at least until said apertures are accessible from within the container, passing strapping through the apertures in said legs and about an article in said container, tensioning the strapping about the article with said bases flush with the outside of the container whereby said bases react forces exerted by the tensioning and securing the free ends of said strapping together.

2. The method of claim 1 wherein the free ends of said strapping are secured by a friction buckle.

3. The method of claim 1 wherein the free ends of said strapping are secured by a compression clamp.

4. The method of claim 1 wherein a piece of strapping is secured to each of said legs prior to insertion of said legs through the slits, the strapping is pulled through the slits and the free ends thereof are secured in tension about an article in said container.

5. The method of claim 4 wherein the free ends of said strapping are secured by a friction buckle.

6. The method of claim 4 wherein the free ends of said strapping are secured by a compression clamp.

7. A method of securing an article to a panel member which comprises the steps of providing at least two anchor clips, each anchor clip comprising a generally planar base having an upstanding leg, said leg having a free end opposite said base, said leg defining an aperture therein adjacent said free end, defining slits in said panel member at predetermined locations, inserting said legs through said slits from one side of the panel at least until said apertures in said legs are accessible from the other side of said panel member, passing strapping through the apertures in said legs and about an article in said container, tensioning the strapping about the article with said bases flush against said one side of the panel member whereby said bases react forces exerted by the tensioning and securing the free ends of said strapping together.

8. The method of claim 7 wherein the free ends of said strapping are secured by a friction buckle.

9. The method of claim 7 wherein the free ends of said strapping are secured by a compression clamp.

10. The method of claim 7 wherein a piece of strapping is secured to each of said legs prior to insertion of said legs through the slits, the strapping is pulled through the slits and the free ends thereof are secured in tension about an article in said container.

11. The method of claim 10 wherein the free ends of said strapping are secured by a friction buckle.

12. The method of claim 10 wherein the free ends of said strapping are secured by a compression clamp.

13. A method of securing an article to a panel member which comprises the steps of providing two anchor pads, each anchor pad comprising a section of planar material, providing a pair of anchor clips, each anchor clip comprising a base having an upstanding leg, said leg having a free end opposite said base, said leg defining an aperture therein adjacent said free end, defining slits in said anchor pads, inserting said legs through said slits, from one side of said anchor pads until said apertures are accesible from the other side of said anchor pads bonding said anchor pads to said panel member, passing strapping through the apertures in said legs and about an article on said panel member, tensioning the strapping about the article and securing the free ends of said strapping together with said bases reacting the forces of tensioning against said bonded pads.

14. The method of claim 13 further comprising the step of forming said anchor pads of the same material as said panel member.

15. The method of claim 13 comprising the step of forming said anchor pads and simultaneously defining said slits therein.

16. The method of claim 13 wherein the free ends of said strapping are secured by a friction buckle.

17. The method of claim 13 wherein the free ends of said strapping are secured by a compression clamp.

18. The method of claim 13 wherein a piece of strapping is secured to each of said legs prior to insertion of said legs through the slits, the strapping is pulled through the slits and the free ends thereof are secured in tension about an article in said container.

19. The method of claim 17 wherein the free ends of said strapping are secured by a friction buckle.

20. The method of claim 17 wherein the free ends of said strapping are secured by a compression clamp.

21. The method of claim 13 wherein said step of bonding includes the application of an adhesive to one of said anchor pad and said anchor clips.

22. The method of claim 13 wherein said step of bonding includes the application of an adhesive to said anchor pads.

* * * * *